US011752050B1

(12) United States Patent
Cooper et al.

(10) Patent No.: US 11,752,050 B1
(45) Date of Patent: Sep. 12, 2023

(54) PORTABLE AND INFLATABLE PATIENT ISOLATION CHAMBER/STRETCHER SYSTEM

(71) Applicant: PEKE SAFETY LLC, Naples, FL (US)

(72) Inventors: Peter Cooper, Naples, FL (US); Stuart Fuller, Bedfordshire (GB); Brett Cooper, Silver Spring, MD (US)

(73) Assignee: Peke Safety LLC, Naples, FL (US)

( * ) Notice: Subject to any disclaimer, the term of this patent is extended or adjusted under 35 U.S.C. 154(b) by 672 days.

(21) Appl. No.: 16/512,759

(22) Filed: Jul. 16, 2019

Related U.S. Application Data

(60) Provisional application No. 62/672,782, filed on May 17, 2018.

(51) Int. Cl.
*A61G 10/00* (2006.01)
*A61G 10/02* (2006.01)
*A61G 1/013* (2006.01)

(52) U.S. Cl.
CPC ..... *A61G 1/013* (2013.01); *A61G 10/02* (2013.01); *A61G 10/005* (2013.01)

(58) Field of Classification Search
CPC ..... A61G 1/013; A61G 10/00-04; A61G 11/00-009
See application file for complete search history.

(56) References Cited

U.S. PATENT DOCUMENTS

| | | | | |
|---|---|---|---|---|
| 6,001,057 | A * | 12/1999 | Bongiovanni et al. | A62B 31/00 5/629 |
| 6,217,507 | B1 * | 4/2001 | Bonvik | A61G 10/005 600/21 |
| 2005/0004423 | A1 * | 1/2005 | Shenosky et al. | A61G 10/005 600/21 |
| 2006/0247487 | A1 * | 11/2006 | Arts et al. | A61G 11/009 600/21 |
| 2016/0166455 | A1 * | 6/2016 | Steinert | A61B 42/10 600/21 |
| 2017/0231848 | A1 * | 8/2017 | VanBasten | A61G 3/008 600/21 |
| 2019/0380901 | A1 * | 12/2019 | Breegi | A61G 13/108 |

* cited by examiner

*Primary Examiner* — Thaddeus B Cox
(74) *Attorney, Agent, or Firm* — Rosenberg, Klein & Lee

(57) ABSTRACT

A portable and inflatable patient isolation chamber and stretcher system having an exoskeletal frame, which when inflated, forms a substantially tent contour enclosure when coupled to an inflatable flexible base. The exoskeletal frame has an apex section formed by a flexible apex conduit which is coupled to and in fluid communication with first and second flexible end conduits. The inflatable flexible base is connected to the exoskeletal frame and is in fluid communication with the exoskeletal frame for providing a flexible platform for the patient. A transparent envelope is secured to the exoskeletal frame and inflatable flexible base for forming a patient isolation chamber. When deflated, the flexible base can serve as a stretcher for transport of the patient.

18 Claims, 10 Drawing Sheets

PORTABLE AND INFLATABLE PATIENT ISOLATION CHAMBER/STRETCHER SYSTEM

REFERENCES TO RELATED PATENT APPLICATIONS

This Patent Application is based upon Provisional Application Serial No. 62/672,782, filed on 17 May 2018.

FIELD OF THE INVENTION

The subject system concept is directed to the field of emergency medical treatment systems.

In particular, the subject system relates to a patient isolation system, as well as a transportation mechanism for a patient where the isolation system protects the patient against exposure to a hazardous environment and protects persons treating the patient against contamination from the patient.

Still further, the subject system is related to an inflatable isolation chamber using inflatable supporting structures which can be inflated/deflated in a rapid manner for use in treating patients who are highly infectious, exposed to bacteriological, chemical, and/or radiological hazards or other environments which necessitate isolation of the patient during treatment.

More in particular, the subject system relates to the field of medical devices used for transportation, as well as isolation and treatment of intensive care patients where the patients may be remote from a medical facility or may be in need of transportation to a medical facility.

Still further, the subject system directs itself to a self-contained transportable life support system which may be used for transport, resuscitation and stabilization of patients which may be the result of battlefield casualties, strokes, heart attacks, accidents, or some like happening.

Still further, the subject system provides an inflatable isolation medical pod, as well as an inflatable stretcher system to permit isolation of the patient as well as providing a mechanism for transport of the patient and provides convertibility between a mode of use where the patient is protected against undesirable exposure to a hazardous environment, as well as a mode of protecting against contaminants reaching persons external to the isolation chamber by the patient who is isolated within the chamber.

Further, the subject concept is directed to a portable inflatable isolation chamber and stretcher system which can be inflated to provide isolation for the patient, as well as being deflatable to permit portable isolation chamber and stretcher system to be folded and carried in a backpack from one area to another.

More in particular, the subject concept directs itself to an inflatable portable patient isolation chamber and stretcher system which is formed of materials allowing flotation and rapid frontline marine support to result in casualties being treated and transported in an efficient and speedy manner.

More in particular, the subject system provides for a combined stretcher and isolation chamber which eliminates the need to transfer the patient to another stretcher when being transported and results in speedier treatment and lowers patient trauma reactions.

Still further, the subject system is composed of a plurality of assembling members which are devoid of metal parts which enables patients within the isolation chamber to be scanned without the need to transfer to another stretcher for scanning purposes.

More in particular, the subject system includes components which are formed of a shell outer layer laminated to an inner woven fabric to form an outer laminated skin with drop stitching polyester threads being sewed between the outer laminated skin and the inner woven fabric to allow for high pressure air or other gas to be inserted or formed into a substantially rigid isolation chamber sufficient to accept the structural loads imparted to the system.

BACKGROUND OF THE INVENTION

Transporting as well as treating patients in generally remote areas present a number of problem areas. Generally, medics, caregivers, and/or doctors initially treat the patient at the scene of an accident or where the patient has become contaminated or otherwise disabled and will need treatment at the scene or enroute to a medical facility. Thus, caregivers may become contaminated from emanations from the patient and alternatively the patient being treated may be contaminated by the caregivers.

When a patient is a victim subjected to a contaminated environment, or is injured, the patient is placed within an enclosure for immediate care or transportation to a medical facility. In many cases, treatment to be given to the patient is of extreme importance with respect to time, and in such cases, in order to treat the patient, it is generally necessary that the patient be quickly isolated and positioned in an enclosure within which the medical personnel may treat the patient with additional surgical implements in a manner which allows access to the patient without introduction of any contaminants into the enclosure containing the patient, and further, without risking any contamination of the medical personnel from the patient.

Thus, it is generally necessary to isolate the patient from the environment when some type of biological (bacterial, viral or other), chemical, and/or radiological hazards are present and provide an efficient mechanism for transport of the patient.

Additionally, in isolation chambers, the ambient or external atmosphere may be contaminated and it is necessary that the patient placed within the containment device or isolation chamber is supplied with sufficient air being provided to the patient in a purified and filtered manner subsequent to placement in the isolation chamber to facilitate the treatment while minimizing trauma to the patient during treatment.

In some cases, if the patient has suffered an infectious disease, it is necessary to have the air filtered or purified before it is discharged from the interior of the isolation chamber into the external environment. Additionally, during treatment, the patient within the isolation chamber may have to be scanned and thus, it is important that in order to obtain a true reading of the scanned patient, that there be no metal objects or components of the isolation chamber formed of metal-like compositions. Thus, it is important that the isolation chamber and all components forming parts thereof, are devoid of metal-like compositions which would inhibit the scanning process.

It is important that a mechanism be provided to permit access to the person being treated without introducing contaminants into the enclosure in order to maintain a somewhat sterile environment with respect to any external contaminants. It is thus desirable and necessary to isolate the patient from the environment when the environment may contain substances which may be detrimental to the patient being treated.

As an example, when a patient has suffered severe blood loss, or is experiencing some difficulty in the breathing process, it is necessary to prevent the patient from breathing various contaminants which may be introduced from the external environment. Thus, specifically, it is necessary to isolate the medical patient from the environment when bacteriological, chemical, and/or radiological hazards are present.

In some cases, there is the necessity to facilitate the removal of toxic and/or infectious residues which may be present on the clothing and/or skin of the patient being treated and thus, allow the patient to become further stabilized during treatment or transit to an appropriate medical facility. It is necessary to provide the patient who is isolated within the isolation chamber with an environment that is provided with circulated air which is decontaminated through filters and refreshed so that toxic and infectious residues are removed from the isolated patient's contamination area within the isolation chamber.

It is a further necessity that caregivers external to the isolation chamber be isolated from the patient having some type of contagious disease or having been exposed to a bacteriological, chemical, or radiological contamination.

Thus, there is a long felt need for providing an inexpensive, easily compatible and storable isolation chamber and stretcher system which can be held in inventory by military and/or civilian defense organizations, and/or other organizations which are in need of isolation chambers for patients being treated and/or patients needing transport.

PRIOR ART

There are numerous systems and structures available in the prior art to isolate a patient for protection against exposure to a hazardous environment, and protecting personnel from contamination from a patient. Such prior art device systems monitor the patient, as well as isolate the potentially infectious patient from caregivers to prevent exposure and/or contamination from the patient to the caregivers as well as protecting caregivers from being contaminated by the patient.

In a number of prior art devices, such are directed to use with an individual patient who is exposed to ambient contamination from, for example, chemical, biological, infectious agents, environmental and radiation sources.

Such prior art systems available for treating a patient in a remote region or in the field are generally ineffective in providing an environment conducive to the administration of total medical care and thus, may cause treatment to be delayed until the patient is moved to a medical facility. Such prior art systems are generally deficient in providing an environment where both patient and medical personnel treating the patient are both protected from contaminants.

Some prior art systems, such as that disclosed in U.S. Pat. #6,461,290, are provided with collapsible isolation systems which are generally formed of a plastic-like composition, however, such systems do not provide for a total inflation under pressure of all frame structures of the proposed isolation systems. In other prior art systems, such as that seen in U.S. Pat. #6,971,985, such are directed to isolation chambers, however, such systems include rib structures as structural members being used to shape the overall isolation chamber. However, once again, such rib structures are generally solid in nature and do not provide for inflation of all component parts of an overall frame structure to allow ease of inflation/deflation to provide a system which can be folded into a volume adaptable to be carried in a backpack for transport of the deflated system.

In other prior art, such as that disclosed in U.S. Pat. #6,241,653, there is used a military litter for transport of the patient, however, such prior art does not provide for any inflatable base which can be folded into a restricted volume for portability of the system over an extended transportation distance.

Other prior art, such as that disclosed in U.S. Pat. #7,503,890 provide for collapsible patient isolation pods, however, such does not provide for all component parts of an overall frame structure to be formed of inflatable/deflatable elements.

SUMMARY OF THE INVENTION

This invention system provides for a portable inflatable and deflatable isolation chamber which includes an exoskeletal frame forming a tent contour. The exoskeletal frame includes an apex portion or section formed by a flexible apex conduit extending in a longitudinal direction. The flexible apex conduit is in fluid communication with a first flexible end conduit and a second flexible end conduit with the first and second end conduits located on opposing longitudinal ends of the apex. An inflatable flexible base is connected to the exoskeletal frame and is in fluid communication therewith. The base is adapted to provide a flexible platform for a patient positioned within the exoskeletal frame having structural integrity sufficient to support the loads imparted to it. A substantially transparent envelope is releasably secured to the exoskeletal frame and the inflatable flexible base with the exoskeletal frame, the base and the transparent envelope forming the isolation chamber.

It is an object of the present invention to provide a portable/ inflatable/deflatable patient isolation system which can be transported to a treatment site.

It is a further object of the present system to provide a portable patient isolation stretcher system which would allow transport of a patient from some remote area to a medical facility or from one location in a medical facility to another location when the system is in an inflated state.

It is a further object of the subject system to provide an inflatable isolation chamber with a frame structure which may be inflated by high pressure air or high pressure carbon dioxide cylinders or other high pressure gases.

It is a further object of the subject system to provide an isolation chamber which may be collapsed to a minimum volume when not in use for transporting the system by a caregiver.

It is a further object of the subject system to provide a lightweight portable/ deflatable isolation system where the system is fabricated without any metal components.

It is still another object of the invention to provide an inflatable isolation system which may be decompressed and folded into a compact volume for easy transport of the isolation chamber system.

It is a further object of the subject system to provide a containment pod or enclosure and envelope fabricated from chemical and/or biochemical resistive materials which are capable of protecting an enclosed patient from the external environment and protecting caregivers external to the enclosure from transmission of contaminants from the isolated patient to the caregivers and alternatively from the caregivers to the patient.

It is a still further object of the subject system to provide a rapid deployment system which allows the isolation chamber system to be quickly deployed to a treatment area.

It is still a further object of the invention to improve medical treatment of a patient where a substantially transparent envelope is provided and includes access mechanisms to the patient which may be hand portals mounted to the transparent envelope which are positioned for allowing complete patient access. Such portal systems maximize the caregiver's hand manipulative abilities and finger functioning dexterity within the isolation chamber.

DESCRIPTION OF THE PREFERRED EMBODIMENTS

Figure 1:
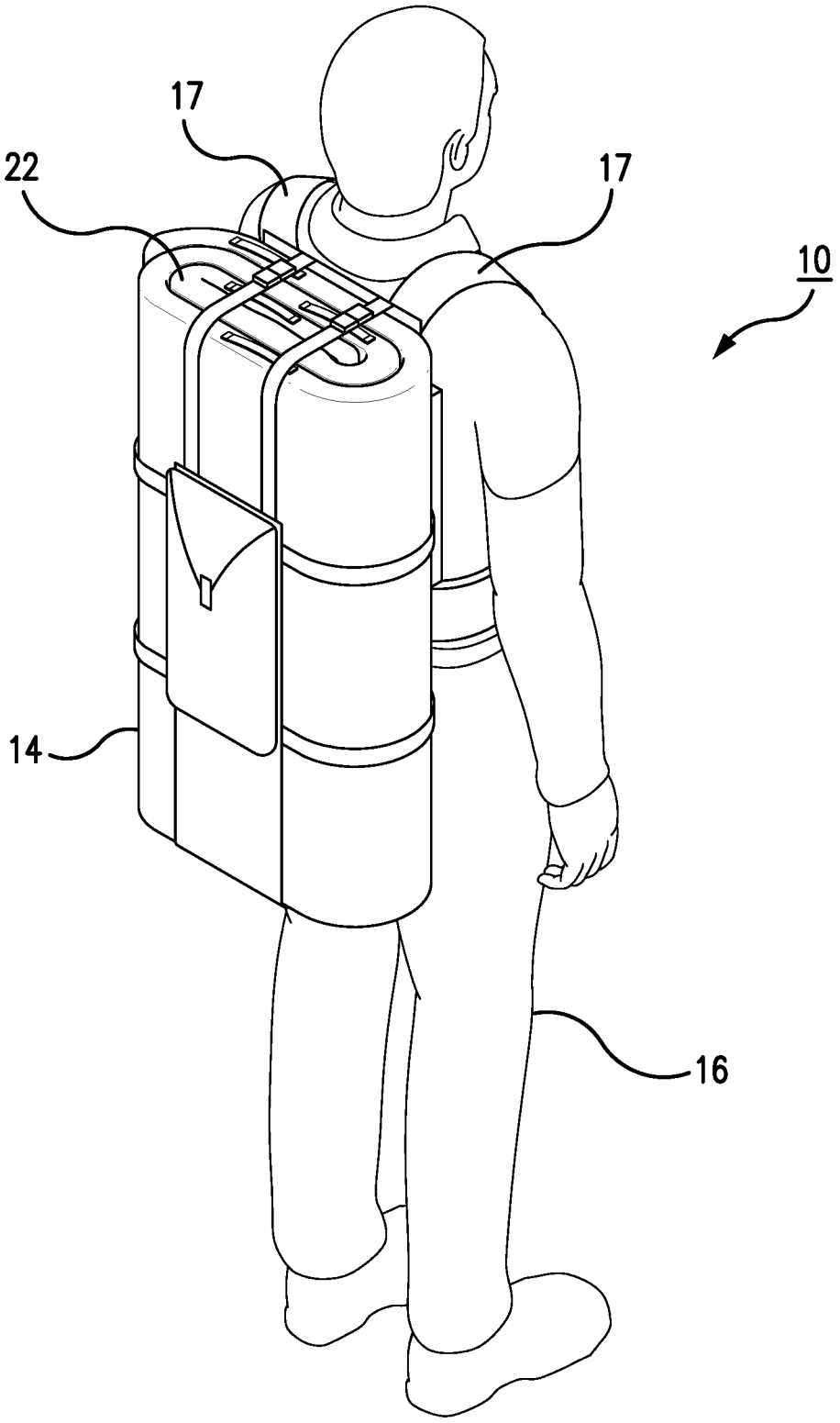
FIG. 1 is a schematic perspective view of a user transporting a deflated isolation chamber system to a treatment site.
Figure 2:
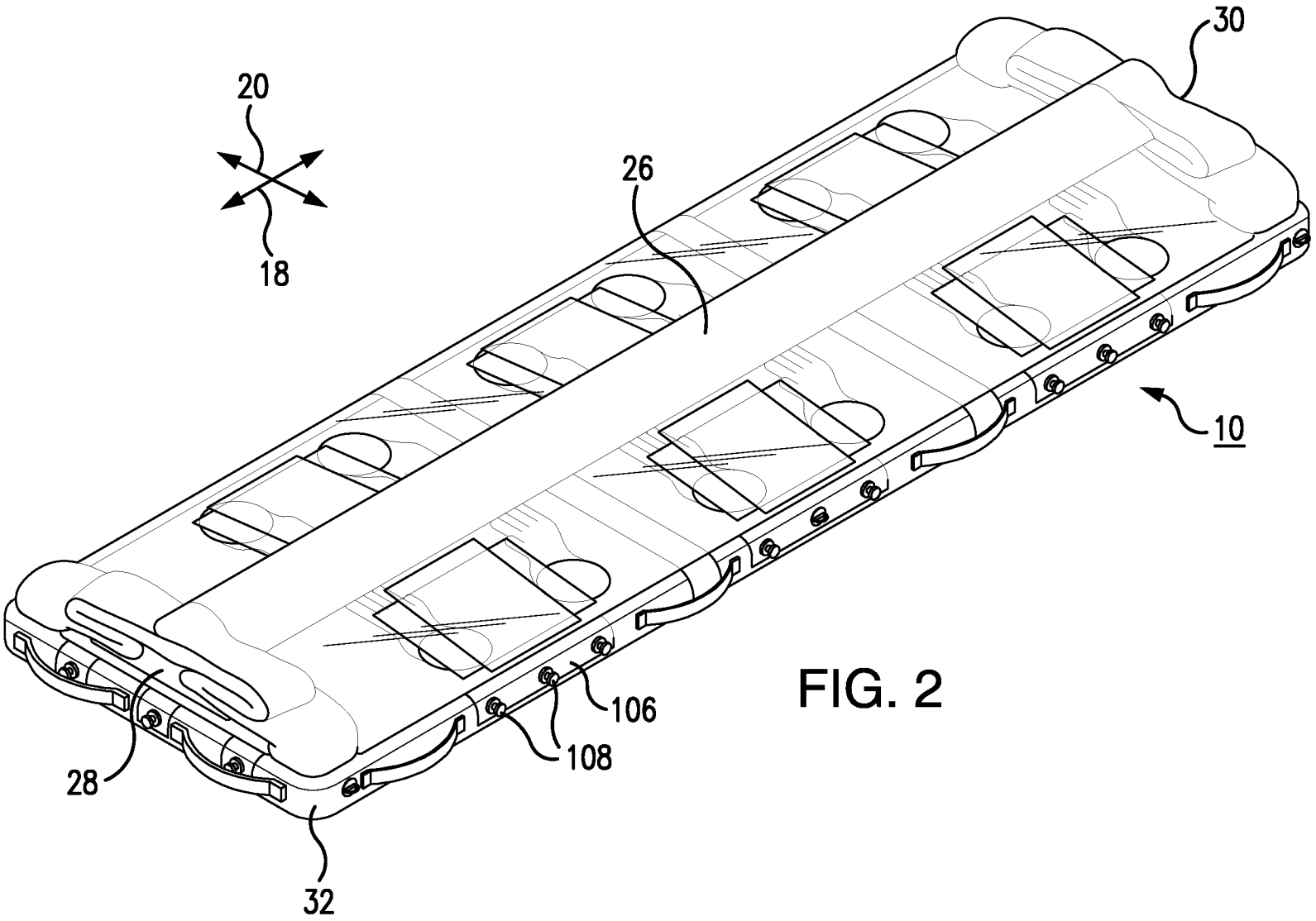
FIG. 2 is a perspective view of the portable/inflatable isolation chamber and stretcher system in at least a partially deflated mode.
Figure 3:
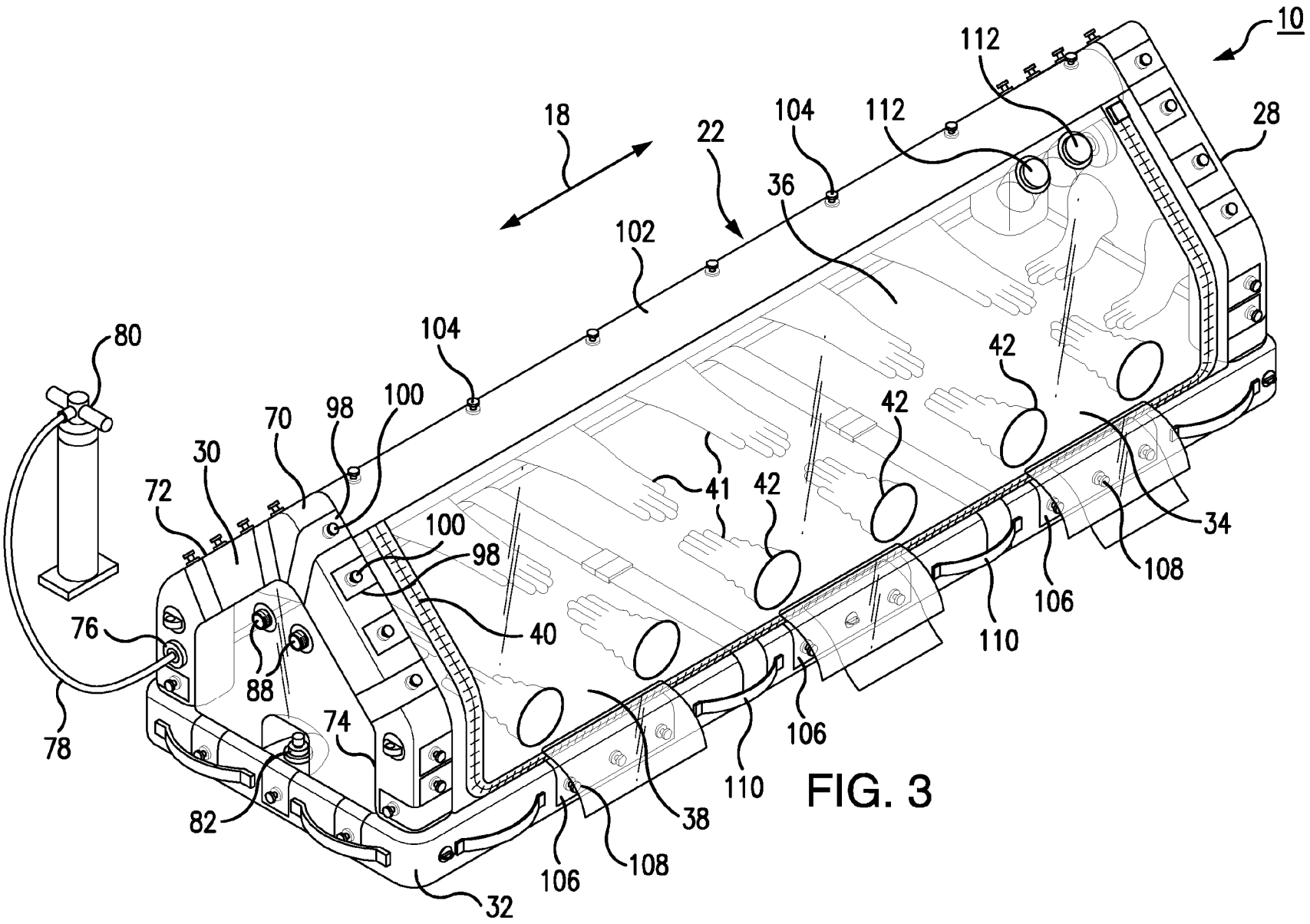
FIG. 3 is a perspective view of the portable/inflatable isolation chamber and stretcher system showing specific components of a first flexible fluid conduit.
Figure 4:
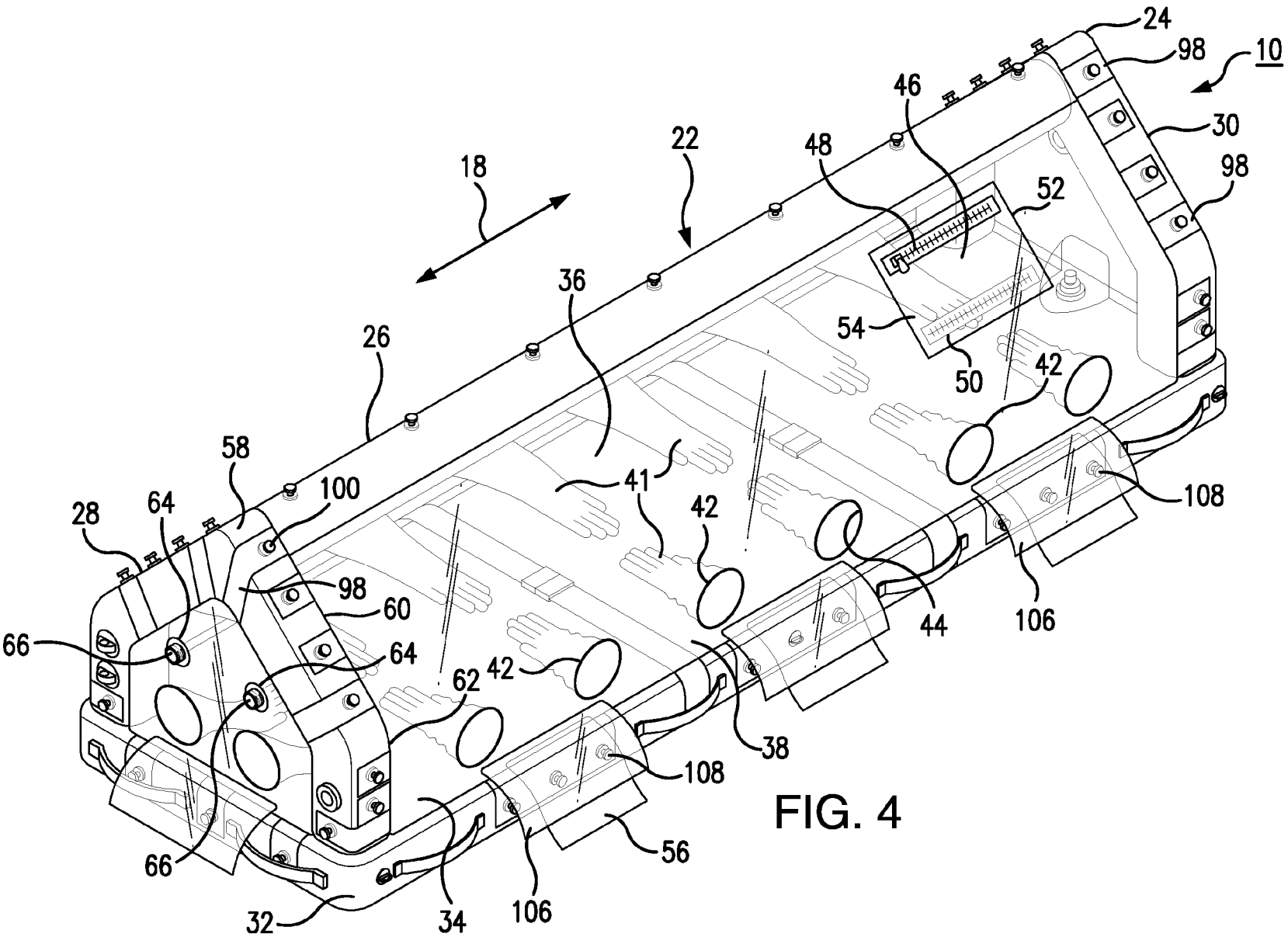
FIG. 4 is a perspective view taken from an opposing side of FIG. 3, showing individual components associated with a second flexible fluid conduit.
Figure 5:
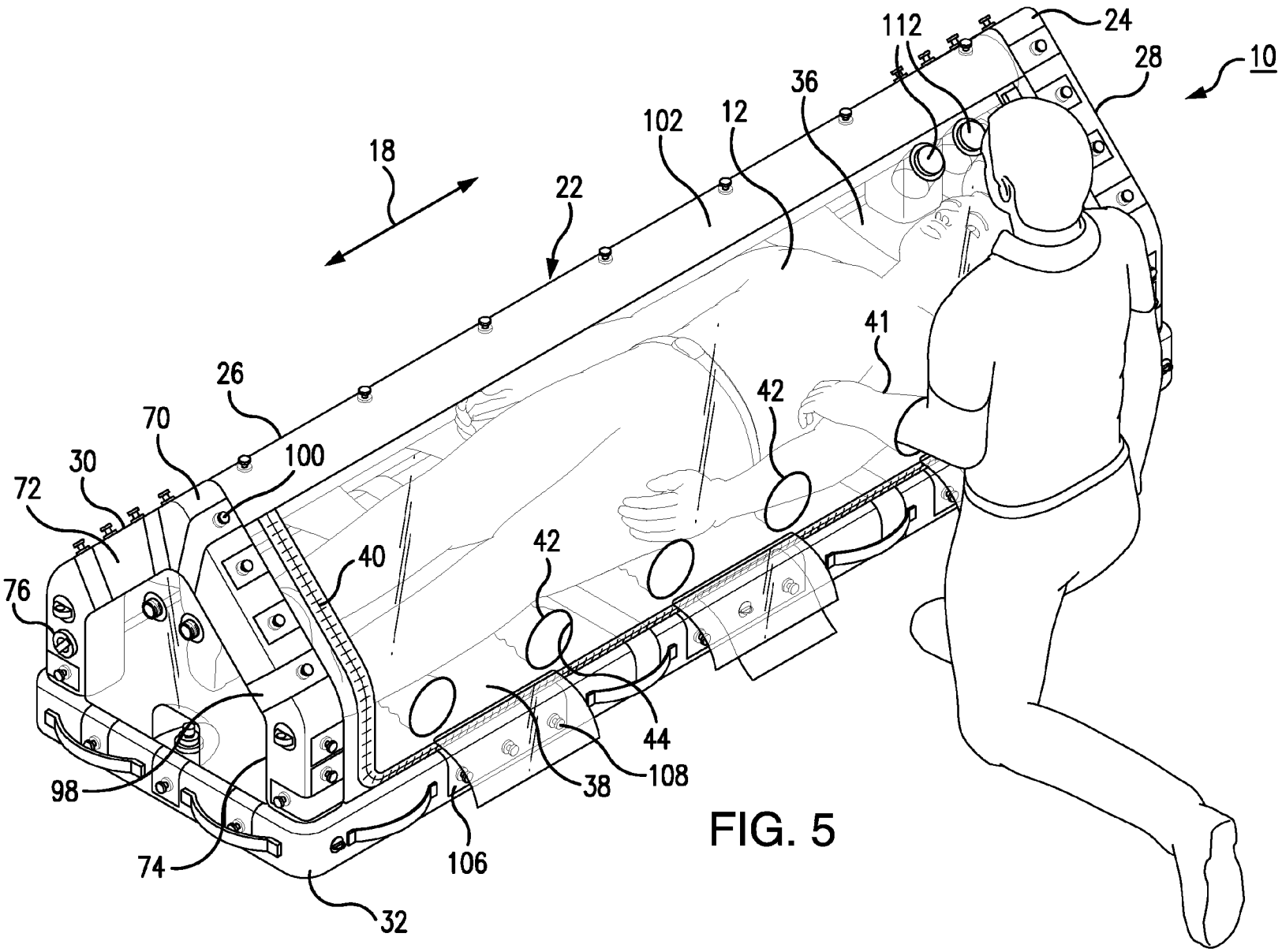
FIG. 5 is a perspective view of a patient within the isolation chamber being attended to by a caregiver.

Referring now to FIGS. 1-3, there is shown a portable/inflatable isolation chamber and stretcher system 10 which may be inflated to accommodate a patient 12, as shown in FIG. 5, where patient 12 is maintained within portable/inflatable isolation chamber and stretcher system 10 for treatment. Portable/inflatable isolation chamber and stretcher system 10 may be operational in an inflated state, as is shown in FIGS. 3-8, or in a deflated mode, as shown in FIGS. 1 and 2. As seen in FIG. 2, portable/inflatable isolation chamber and stretcher system 10 is substantially deflated and may be folded to be received within backpack 14 to be brought to a treatment site by an emergency medical technician, caregiver 16, or other person who is to treat the patient 12. The caregiver 16, as is seen in FIG. 1, may fold portable/inflatable isolation chamber and stretcher system 10 into a small volume for receipt within backpack 14, which may be releasably attached to caregiver 16 through straps 17 or some other releasable attachment, not important to the inventive concept as herein described.

In overall construction, portable/inflatable isolation chamber and stretcher system 10 is adaptable to be inflated to a position shown in FIGS. 3-8, or to a state as shown in FIG. 1, where portable/inflatable isolation chamber 10 is carried on the back of the caregiver 16.

As seen in FIG. 2, when in a substantially deflated mode, portable/inflatable isolation chamber and stretcher system 10 is configured to provide a substantially flat contour which extends in longitudinal direction 18 and lateral direction 20. Due to the deflatability of portable/inflatable isolation chamber and stretcher system 10, as will be described in following paragraphs, portable/inflatable isolation chamber and stretcher system 10 can be folded to present a volume which is adaptable to be carried to a treatment site for treatment of a patient 12, as well as to provide a stretcher for transport of the patient.

Referring now to FIGS. 3-8, portable/inflatable isolation chamber and stretcher system 10 includes an exoskeletal frame 22 which forms an overall tent-like contour when formed with an apex section 24, first and second flexible end conduits 28, 30, and base section 32, as will be described in following paragraphs.

As more clearly seen in FIGS. 3-5, system 10 has the apex section 24 formed by a flexible apex conduit 26 which extends in longitudinal direction 18. Flexible apex conduit 26 is in fluid communication with the first flexible end conduit 28 and the second flexible end conduit 30. As can be seen in the FIGS. 3-5, first and second end conduits 28 and 30 are positioned and located on opposing longitudinal ends of flexible apex conduit 26. It is to be understood that flexible apex conduit 26 and first and second flexible end conduits 28 and 30 are in continuous fluid communication to provide a continuous flow path therebetween. In this manner, high pressure gaseous compositions when inserted into first or second flexible end conduits 28, 30 will allow such high pressure gas, such as air, to inflate flexible apex conduit 26 as well as first and second flexible end conduits 28 and 30. In this configuration, there is formed a rigid structural formation which will maintain its contour during treatment of the patient.

Flexible apex conduit 26 and first and second flexible end conduits 28 and 30 may be formed in one-piece formation or otherwise secured each to the other in order that a continuous fluid flow communication is formed between flexible apex conduit 26 and first and second flexible end conduits 28 and 30.

Additionally, portable/inflatable isolation chamber and stretcher system 10 includes the inflatable/deflatable flexible base 32 which is connected to the exoskeletal frame 22 and is further in fluid communication with exoskeletal frame 22. Inflatable/deflatable flexible base 32 is adapted to provide a flexible platform 34 for the patient 12 positioned within exoskeletal frame 22 or as a stretcher to transport the patient to remote medical facility. Inflatable/deflatable flexible base 32 is mounted to each of first flexible end conduit 28 and second flexible end conduit 30 with a continuous fluid flow path between inflatable/deflatable flexible base 32 and first/second flexible end conduits 28 and 30. Inflatable/deflatable flexible base 32 extends in longitudinal and lateral directions 18 and 20, as is seen in the inflated states shown in FIGS. 3-5.

Substantially transparent or translucent envelope 36 is releasably secured to exoskeletal frame 22 and inflatable/deflatable flexible base 32. Flexible apex conduit 26 and first and second flexible end conduits 28 and 30 are combined to form the overall exoskeletal frame 22 and together with the inflatable/deflatable flexible base 32 and substantially transparent envelope 36 form an isolation chamber 38. In overall contour, exoskeletal frame 22 including flexible apex conduit 26, first flexible end conduit 28, second flexible end conduit 30, inflatable/deflatable flexible base 32, and substantially transparent envelope 36 form an enclosed tent-like contour for acceptance of the positioning and treatment of the patient 12 therein.

Apex section 24 of exoskeletal frame 22, as well as first/second flexible end conduits 28/30 in combination with the inflatable/deflatable flexible base 32 may be heat-welded each to the other, stitched or otherwise formed to provide the continuous fluid flow path between each of the elements forming the exoskeletal frame 22 and inflatable/deflatable flexible base 32.

Each of the inflatable/deflatable flexible base 32, flexible apex conduit 26, first flexible end conduit 28, and second flexible end conduit 30, are generally formed of a flexible composition. Preferably, such elements may be formed of a closed cell polymer, such as a flexible closed cell plastic composition, a laminated fabric or textile material which provides for a sealed structure which is impervious to the transmission of the high pressure gas therethrough.

In this manner, the flexibility of the exoskeletal frame and inflatable/deflatable flexible base 32 permits the user to compact the overall structure into a system which can be seen in FIG. 2, where the portable/inflatable isolation chamber and stretcher system 10 is substantially planar to provide a base platform upon which the patient can be transported. Alternatively, the substantially planar extensions of the portable/inflatable isolation chamber and stretcher system 10 can then be folded when in the deflated mode to be inserted into the backpack 14 to be carried to a necessary treatment site.

It is of importance that the portable/inflatable isolation chamber and stretcher system 10 is formed of a flexible material which provides a sealed enclosure for patient 12 when being treated. The sealing of the portable/inflatable isolation chamber and stretcher system 10 is of great importance, since patients 12, being either operated on or otherwise treated, must be in isolation from the external environment and no, or a minimum, of transport of microbes or other bacterial/viral agents, nuclear or other biological/chemical components be maintained within isolation chamber 38 throughout the treatment. Substantially transparent envelope 36 includes a double lock zipper fastener 40 to permit opening of substantially transparent envelope 36 from exoskeletal frame 22.

Zipper 40 is of a double lock type zipper system commercially available, which ensures isolation and the prevention of any contaminants passing through the zipper area into/out from the isolation chamber 38. As is seen in FIGS. 3 and 5, zipper 40 extends throughout a portion of the periphery of substantially transparent envelope 36. Opening of zipper 40 permits substantially transparent envelope 36 to be movably displaced with respect to exoskeletal frame 22 and flexible base 32. The opening of zipper 40 permits patient 12 to be either inserted or removed from isolation chamber 38 in a convenient, simple and easy manner into or out of the isolation chamber 38.

Referring to FIGS. 3-5, substantially transparent envelope 36 has formed integral therewith a plurality of glove ports 42 which are sealed at their periphery 44 with gloves 41, as seen in the Figures. The glove ports 42 are formed of a flexible closed cell material and are contoured to accept the hands of the caregiver 16. The peripheral edge 44 of the glove ports 42 are continuously sealed around the periphery with gloves 41 in order to maintain isolation of any contaminants which would be transferred internal isolation chamber 38, or passage to the external environment from the interior of isolation chamber 38. Gloves 41 are formed of a closed cell polymer composition or some like composition which is impervious to transfer of contaminants therethrough.

As seen in FIG. 4, as a part of substantially transparent envelope 36, there is formed a double seal pass through compartment 46 which is formed of two layers, an internal layer 52 and an external layer 54, with the internal layer 52 and the external layer 54 forming the double seal pass through compartment 46. As is seen, there is an external zipper lock 48 secured to the external layer 54 and an internal zipper lock 50 secured to the internal layer 52. In this manner, where utensils must be passed into isolation chamber 38, external zipper lock 48 is opened for insert of some treatment utensils and then closed. Through use of the gloves 41 attached to the plurality glove ports 42, the caregiver 16 can then open the internal zipper lock 50, and remove the treatment utensils from the double seal pass through compartment 46 and into isolation chamber 38.

Figure 6:
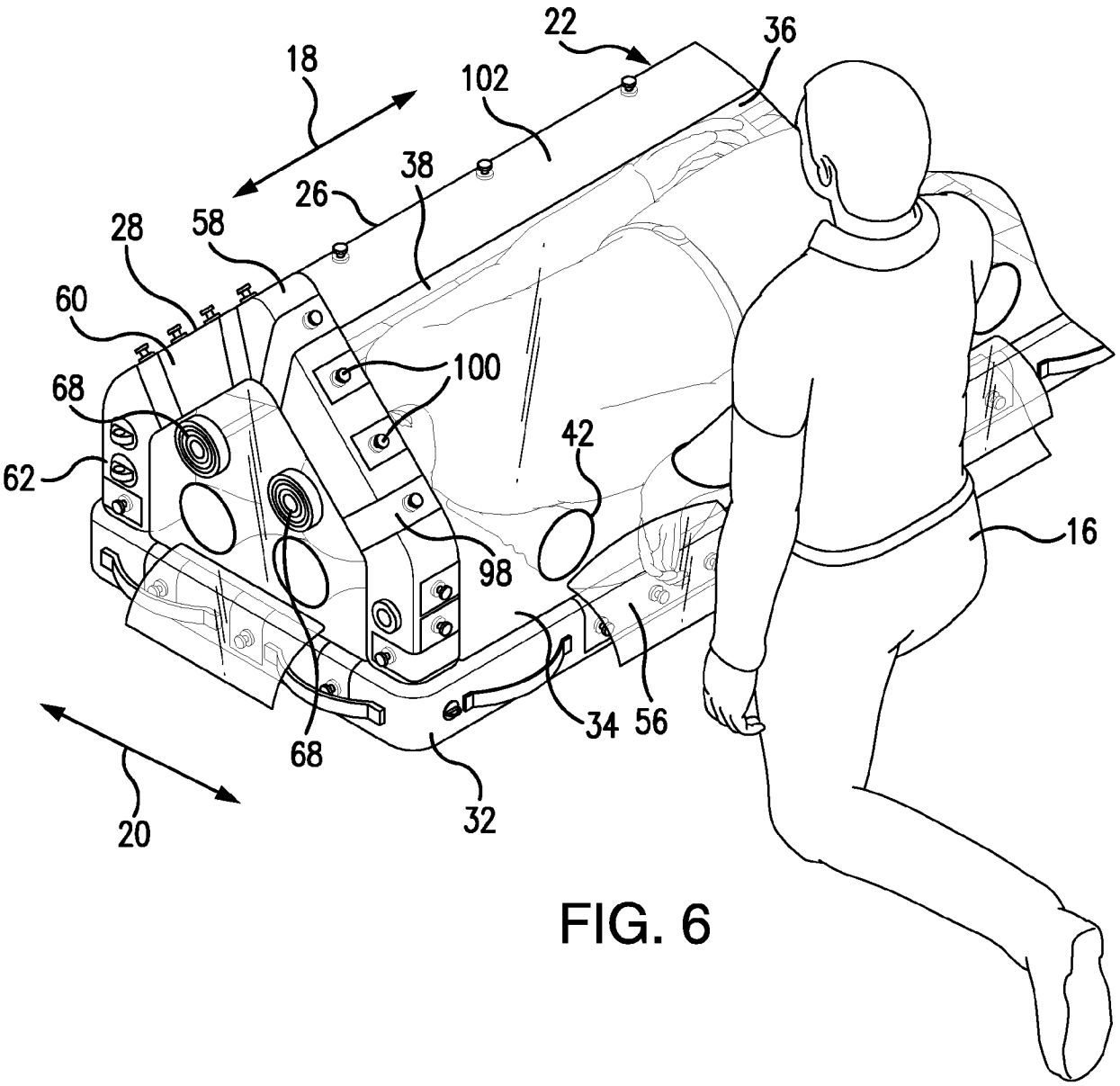
FIG. 6 is a partially cut-away and expanded view of the isolation chamber first flexible conduit system.

Further, substantially transparent envelope 36 has attached thereto on an external surface thereof, instrument pouches 56 in order to allow the caregiver 16 to easily pull or remove instruments necessary for treatment of patient 12. As seen in FIG. 6, instrument pouches 56 permit the caregiver 16 to insert at least one glove 41 attached to glove port 42 into an instrument pouch 56 for use within isolation chamber 38. Instrument pouches 56 are generally attached to an inner surface of substantially transparent envelope 36 and can be used by the caregiver 16 during treatment without the necessity of passing further instruments internal to isolation chamber 38.

Figure 7:
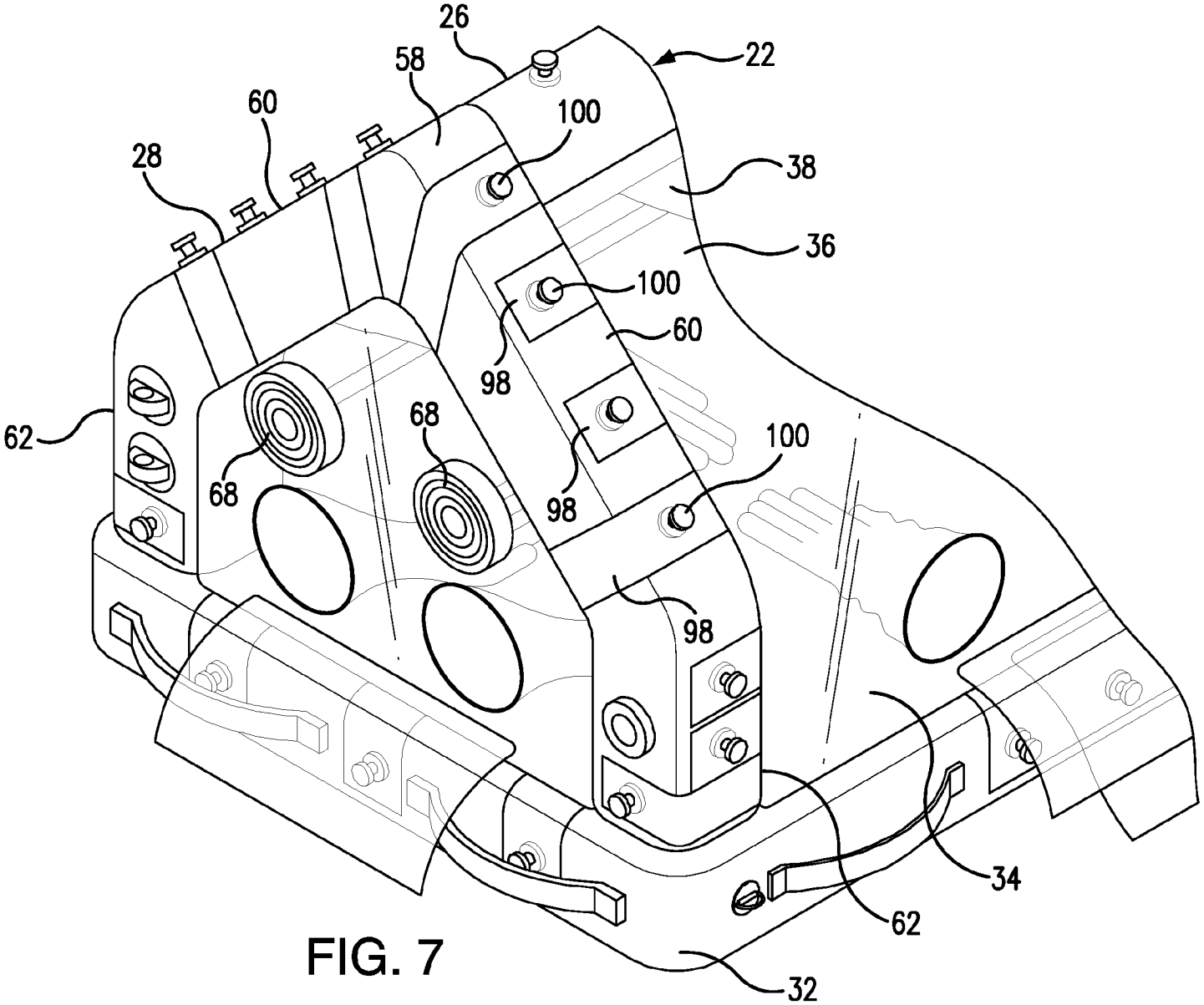
FIG. 7 is an enlarged cut-away perspective view of the first flexible fluid conduit provided with air filters.

Referring now to FIGS. 4 and 6-7, a clearer depiction of first flexible end conduit 28 is seen. First flexible end conduit 28 is formed of a first flexible conduit lower section 62, a first flexible conduit mid-section 60 and first flexible conduit apex section 58 which are joined together to provide a continuous flow path therebetween. First flexible conduit lower section 62 is joined in fluid communication to inflatable/deflatable flexible base 32 in order that flow through inflatable/deflatable flexible base 32 passes through first flexible conduit lower section 62 into first flexible conduit mid-section 60 and first flexible conduit apex section 58, which is then in fluid communication with flexible apex conduit 26.

As is seen, first flexible end conduit 28 is formed in a bridge-like contour and includes a displaced distance in lateral direction 20 between first flexible conduit lower sections 62 formed on laterally disposed ends. The bridge-like or somewhat triangular contour of first flexible end conduit 28 provides for an opening between first flexible conduit lower sections 62 and first flexible conduit mid-sections 60 through which substantially transparent envelope 36 covers.

Figure 9:
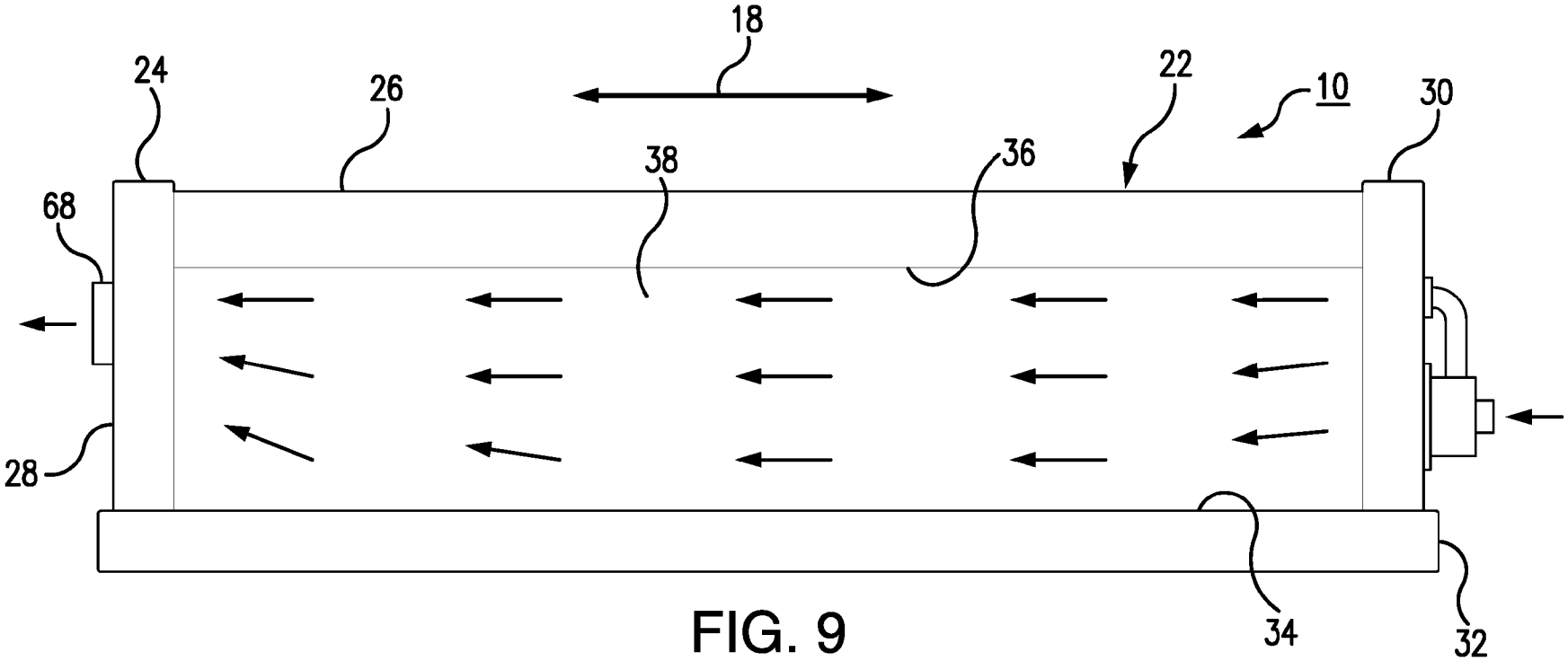
FIG. 9 is a schematic view of air flow through the portable/inflatable isolation chamber and stretcher system.

FIG. 4 shows ventilation ports 64 and mounting threaded members or other types of mounting systems 66 upon which ventilation filters 68 are secured. In this manner, ventilation air can pass through isolation chamber 38 and through ventilation filter 68, as is seen in FIG. 9. As seen in FIG. 6, ventilation filters 68 are mounted to mounting threaded member 66 of the ventilation ports 64. As is further seen in FIGS. 4, 6 and 7, the side sections of substantially transparent envelope 36 adjacent first flexible end conduit 28 include further glove ports 42 to provide further access to internal isolation chamber 38.

Figure 8:
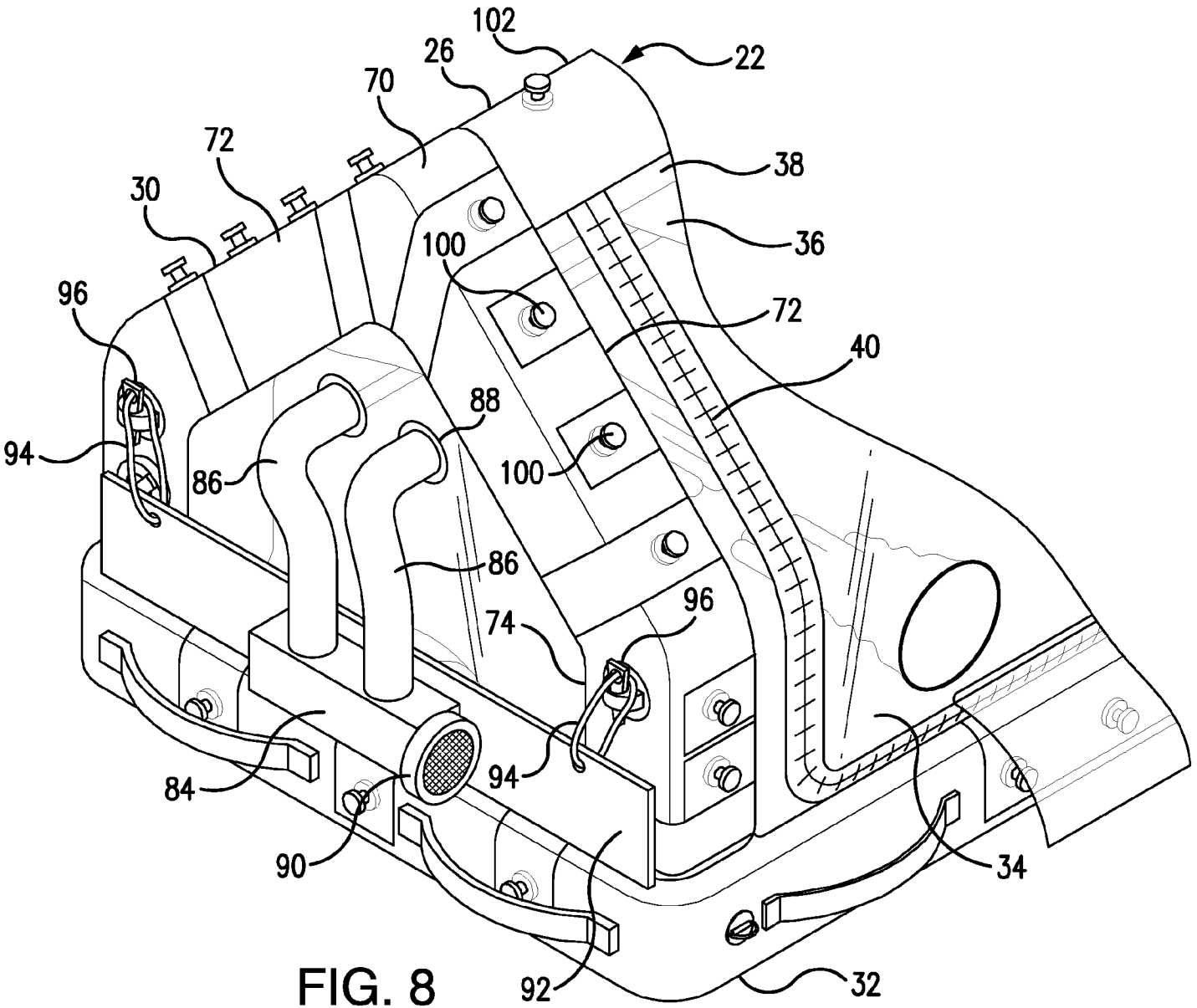
FIG. 8 is a perspective expanded cut-away view of the second flexible fluid conduit showing a ventilation pump attached to and passing through ventilation ports of the second flexible fluid conduits.

Referring now to FIGS. 3, 5, and 8, there is a clear representation of the elements forming second flexible end conduit 30 and attachments thereof. Second flexible end conduit 30 includes second flexible conduit apex section 70, second flexible conduit mid-section 72, and second flexible conduit lower section 74, all in fluid communication each with respect to the other. As was the case for first flexible conduit lower section 62, second flexible conduit lower section 74 is sealed to, and in fluid communication with, inflatable/deflatable flexible base 32. A continuous flow path is provided between second flexible conduit lower section 74, second flexible conduit mid-section 72, and second flexible conduit apex section 70, with second flexible conduit apex section 70, further in fluid communication with flexible apex conduit 26, as previously described. Each of first and second fluid conduits 28 and 30 are formed of a similar closed cell type polymer composition which allows inflation while permitting rigidity when inflated under high pressure.

In order to inflate exoskeletal frame 22 and inflatable/deflatable flexible base 32, there is provided as seen in FIG. 3, second flexible conduit lower section 74 including inflation/deflation port 76 which is in fluid communication with pump hose 78 and manual pump 80, by which the exoskeletal frame 22 and inflatable/deflatable flexible base 32 may be inflated by manual actuation of manual pump 80. Alternatively, an automatic inflation/deflation port 82 is provided in inflatable/deflatable flexible base 32 to allow connection to an automatic pump (not shown).

Referring to FIGS. 3 and 8, it is seen that substantially transparent envelope 36 includes ventilation ports 88 adjacent second flexible end conduit 30. FIG. 3 shows the ventilation ports 88 without a ventilation pump 84 attached. Referring to FIG. 8, ventilation pump 84 is seen connected to ventilation ports 88 through piping or fluid conduits 86 to permit high pressure air to be passed internal isolation chamber 38. As seen in FIG. 8, ventilation pump 84 can have a standard commercially available filter 90 to provide filtered air internal isolation chamber 38. It is to be understood that ventilation pump 84 can provide high pressure air internal isolation chamber 38 or be reversed to draw air from internal isolation chamber 38 through piping 86 and filter 90 for passage to the external environment.

Ventilation pump 84 may be secured to a pump base member 92 through some bolting, or other attachment, not important to the inventive concept as herein described. Pump base member 92 may then be releasably secured to second fluid flexible conduit 30 through ties 94 passing through IV loops or accessory holders 96, as seen in FIG. 8. In this manner, the entire system associated with ventilation pump 84 is releasably securable to second flexible end conduit 30 at the second flexible conduit lower section 74, as shown.

Referring now to FIGS. 3-8, the substantially transparent envelope 36 includes a plurality of tab members 98 extending around at least a portion of the periphery of each of first and second flexible conduits 28 and 30. Tab members 98 are secured and attached to substantially transparent envelope 36 in a manner which allows tab members 98 to be mounted over lugs 100 which are attached to and extend from first and second flexible conduits 28 and 30, as is shown. In this manner, substantially transparent envelope 36 is secured in a releasable manner to first and second flexible fluid conduits 28 and 30.

As is seen in FIGS. 3-6, substantially transparent envelope 36 includes a longitudinally extending continuous apex tab member 102 which is securable to apex lug members 104 to insure a closed fitting of substantially transparent envelope 36 to flexible apex conduit 26.

Inflatable/deflatable flexible base 32, as is seen in FIGS. 2-4, includes a plurality of base lug members 108 extending therefrom and releasably attachable to base envelope tab members 106 extending from substantially transparent envelope 36. For ease of transportability, as seen in FIGS. 2-6, inflatable/deflatable flexible base 32 includes a plurality of hand straps 110 to allow transportability of either the entire portable/inflatable isolation chamber and stretcher system 10 or the inflated/deflated flexible base 32. Referring to FIGS. 3 and 5, there is provided IV ports 112 through which IV instruments may be passed internal isolation chamber 38.

An important consideration in the fabrication of portable/inflatable isolation chamber and stretcher system 10 is the use of drop-stitch technology to construct the overall exoskeletal frame 22 and inflatable/deflatable flexible base 32. Flexible fluid conduits 28 and 30, as well as inflatable/deflatable flexible base 32 of the exoskeletal frame 22 may include an outer shell layer 114, and a shell inner layer 116 joined by drop stitching with vertical or drop-stitch fibers 118.

Drop stitch technology permits construction of inflatable members to a point where they are substantially rigid members when inflated but flexible when deflated to allow folding or compacting of the inflatable members to a relatively small package volume. In overall concept, the drop stich technology joins a pair of polyester or other woven support fabric with fine threads. There is sewn a continuous and evenly spaced thread passed back and forth between the fabrics which locks them together in a strong structural manner.

Figure 10:
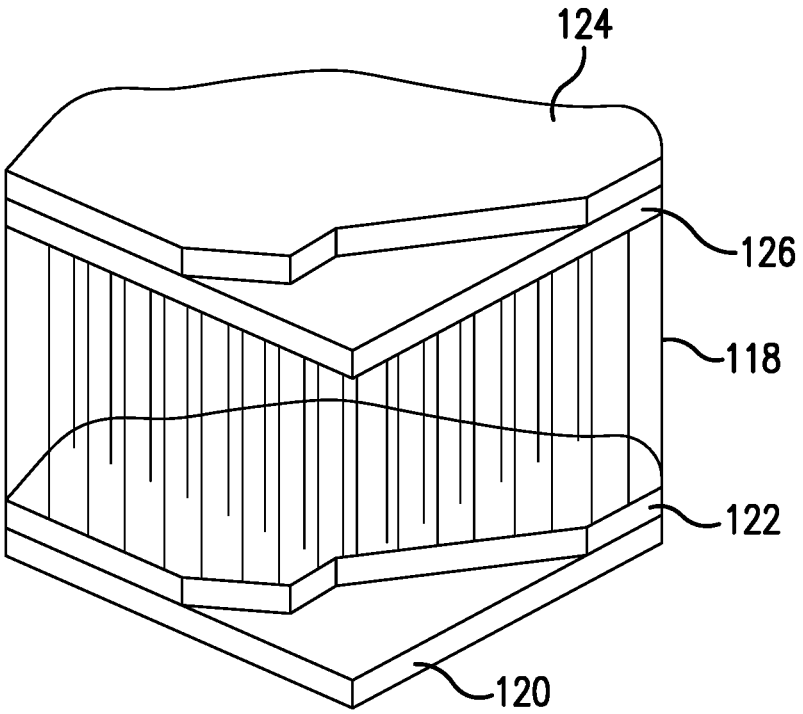
FIG. 10 is a schematic perspective view of securement of shell layers to the components of the flexible/portable isolation system; and, FIG. 11 is a schematic elevational view of components of the isolation chamber system being sewn together utilizing drop stitch technology for maintaining structural integrity of the isolation chamber system.
Figure 11:
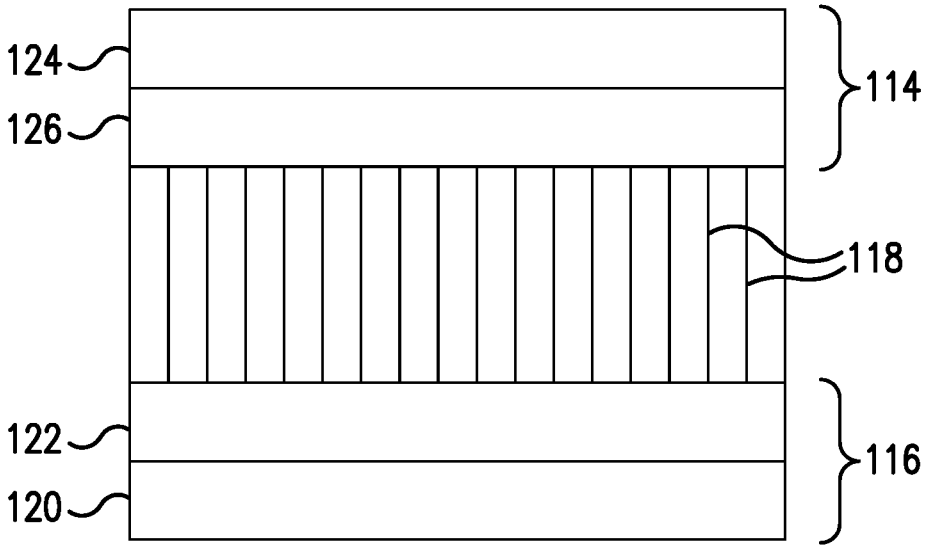

Shell inner layer 116 may be fabricated by laminating inner laminated skin 120 to inner woven fabric 122. In general, drop-stitch construction of exoskeletal frame 22 and inflatable/deflatable flexible base 32 may be formed by establishing shell outer layer 114 impervious to gas or other fluid passage therethrough. Shell outer layer 114 may be formed of some type of flexible closed shell plastic or other like material, which is impervious to passage of particulates and gaseous emanations. In construction, shell outer layer 114 is generally laminated to inner woven fabric 122 to form an outer laminated skin 124. Drop-stitching polyester threads may then be sewed between outer laminated skin 124 and inner woven fabric 122, as is seen in FIGS. 10 and 11. By providing thousands of stitchings, sufficient provision is made to permit high pressure air or other high pressure gas, such as carbon dioxide, to be inserted to form a rigid structure which is capable of supporting a large weight, for example, 300 kg.

The use of drop-stitch technology provides a lightweight, inflatable exoskeletal frame 22 and inflatable/deflatable flexible base 32 which when inflated, stiffens and maintains the properties of a rigid structural construction. The vertical or drop-stitch fibers 118 connect inner laminated skin 120 and outer laminated skin 124. Use of drop-stitch technology allows for the overall system to be foldable or otherwise compactible into a small volume when portable/inflatable isolation chamber and stretcher system 10 is not in use or being transported to a treatment site.

Although this invention has been described in connection with specific forms and embodiments thereof, it will be appreciated that various modifications other than those discussed above may be resorted to without departing from the spirit or scope of the invention as defined in the appended claims. For example, functionally equivalent elements may be substituted for those specifically shown and described, certain features may be used independently of other features, and in certain cases, particular locations of elements, steps, or processes may be reversed or interposed, all without departing from the spirit or scope of the invention as defined in the appended claims.

What is claimed is:

1. A portable and inflatable patient isolation chamber and stretcher system comprising:

(a) an exoskeletal frame having an apex section formed by a flexible apex conduit extending in a longitudinal direction, said flexible apex conduit in fluid communication with a first flexible end conduit and a second flexible end conduit, said first and second flexible end conduits located on opposing longitudinal ends of said flexible apex conduit;

(b) an inflatable flexible base connected to said exoskeletal frame in fluid communication therewith, said inflatable flexible base adapted to provide a flexible platform for a patient; and, (c) a substantially transparent envelope releasably secured to said exoskeletal frame and said inflatable flexible base, with said exoskeletal frame, said inflatable flexible base and said substantially transparent envelope forming an isolation chamber, said substantially transparent envelope including a plurality of envelope tab members for releasable attachment to said first and second flexible end conduits, said inflatable flexible base, and said flexible apex conduit, wherein each of said first and second flexible end conduits, said inflatable flexible base and said flexible apex conduit include a fastening lug for releasable attachment to respective ones of said envelope tab members.

2. The portable and inflatable patient isolation chamber and stretcher system as recited in claim 1 where each of said first and second flexible end conduits extend in a lateral direction where said exoskeletal frame and said inflatable flexible base have a continuous flow path therebetween.

3. The portable and inflatable patient isolation chamber and stretcher system as recited in claim 1 where said substantially transparent envelope is formed of a closed cell polymer composition.

4. The portable and inflatable patient isolation chamber and stretcher system as recited in claim 1 where said substantially transparent envelope is formed of a plastic composition.

5. The portable and inflatable patient isolation chamber and stretcher system as recited in claim 1 with a resealable envelope fastener extending throughout a portion of a surface area of said substantially transparent envelope.

6. The portable and inflatable patient isolation chamber and stretcher system as recited in claim 5 where said resealable envelope fastener is a zipper.

7. The portable and inflatable patient isolation chamber and stretcher system as recited in claim 1 including a double seal flexible container having a first container surface and a second container surface forming a flexible container chamber therebetween.

8. The portable and inflatable patient isolation chamber and stretcher system as recited in claim 7 where said first container surface faces internal said isolation chamber and said second container surface faces external said isolation chamber, each of said first and second container surfaces incorporating a respective resealable container fastener.

9. The portable and inflatable patient isolation chamber and stretcher system as recited in claim 1 where said substantially transparent envelope includes:

(a) a plurality of glove ports formed through said substantially transparent envelope and, (b) a plurality of gloves secured to a periphery of said respective glove ports in sealing relation thereto.

10. The portable and inflatable patient isolation chamber and stretcher system as recited in claim 1 including a plurality of utensil bags attached to a side surface of said substantially transparent envelope and extending external said isolation chamber.

11. The portable and inflatable patient isolation chamber and stretcher system as recited in claim 1 including a ventilation pump releasably secured to said substantially transparent envelope for providing air flow into said isolation chamber, said ventilation pump positioned adjacent said second flexible end conduit.

12. The portable and inflatable patient isolation chamber and stretcher system as recited in claim 11 where said ventilation pump is secured to at least one ventilation pump pipe adapted to interface with at least one ventilation port formed within said substantially transparent envelope.

13. The portable and inflatable patient isolation chamber and stretcher system as recited in claim 12 where said ventilation pump includes an air filter for pumping filtered air through said at least one ventilation pump pipe and internal said isolation chamber.

14. The portable and inflatable patient isolation chamber and stretcher system as recited in claim 11 including at least one ventilation outlet port formed through said substantially transparent envelope adjacent said first flexible end conduit.

15. The portable and inflatable patient isolation chamber and stretcher system as recited in claim 14 including at least one outlet filter formed in secured relation to said at least one ventilation outlet port.

16. The portable and inflatable patient isolation chamber and stretcher system as recited in claim 1 including a mechanical port formed in said inflatable flexible base and adapted to be fluidly in communication with a mechanical pump.

17. The portable and inflatable patient isolation chamber and stretcher system as recited in claim 1 including a plurality of hand grips secured to said inflatable flexible base and adapted for transport of said patient.

18. A portable and inflatable patient isolation chamber and stretcher system comprising:

(a) an exoskeletal frame having an apex section formed by a flexible apex conduit extending in a longitudinal direction, said flexible apex conduit in fluid communication with a first flexible end conduit and a second flexible end conduit, said first and second flexible end conduits located on opposing longitudinal ends of said flexible apex conduit;

(b) an inflatable flexible base connected to said exoskeletal frame in fluid communication therewith, said inflatable flexible base adapted to provide a flexible platform for a patient;

(c) a substantially transparent envelope releasably secured to said exoskeletal frame and said inflatable flexible base, with said exoskeletal frame, said inflatable flexible base and said substantially transparent envelope forming an isolation chamber; and, (d) a manual inflation pump releasably secured to a manual inflation port formed in said second flexible conduit for manually inflating said exoskeletal frame and said inflatable flexible base.

* * * * *